US005562471A

United States Patent [19]

Kato

[11] Patent Number: 5,562,471

[45] Date of Patent: Oct. 8, 1996

[54] WATERPROOF CONNECTOR

[75] Inventor: Tetsuo Kato, Shizuoka, Japan

[73] Assignee: Yazaki Corporation, Tokyo, Japan

[21] Appl. No.: 408,286

[22] Filed: Mar. 22, 1995

[30] Foreign Application Priority Data

Mar. 24, 1994 [JP] Japan ..... 6-053844

[51] Int. Cl.[6] ..... H01R 13/52

[52] U.S. Cl. ..... 439/274; 439/272

[58] Field of Search ..... 439/271, 283, 439/586, 587

[56] References Cited

U.S. PATENT DOCUMENTS 5,295,865 3/1994 Endo et al. ..... 439/271

5,372,516 12/1994 Maeda ..... 439/271

5,472,352 12/1995 Nishide et al. ..... 439/274

*Primary Examiner*—David L. Pirlot

*Attorney, Agent, or Firm*—Sughrue, Mion, Zinn, Macpeak & Seas

[57] ABSTRACT

A waterproof connector includes a housing having a cavity formed therein, and a male terminal inserted in the housing, the male terminal being connected to a covered wire. A front end portion of a covering of the covered wire of a small diameter is placed on a surface of a base plate, and is clamped. The male terminal, connected to the small-diameter covered wire with a rubber plug, is inserted into the housing, and the rubber plug is fitted in the cavity formed in a rear end portion of the housing. The cavity is formed in the housing in such a manner that a centerline of the cavity is offset from a centerline of the rubber plug in a direction X away from the base plate surface.

3 Claims, 4 Drawing Sheets

WATERPROOF CONNECTOR

BACKGROUND OF THE INVENTION

1. Field of the invention

This invention relates to a waterproof connector used for a wire harness in an automobile. More specifically, the invention relates to a waterproof connector including a connector housing which ensures a waterproof function of a rubber plug attached to a covered wire even if any one of predetermined covered wires of different diameters is connected to a predetermined connection terminal.

2. Related art

In many cases, connectors, used for a wire harness in an automobile, are required to have a waterproof function. In such a connector, when a connection terminal with a wire is inserted into a connector housing (hereinafter referred to merely as "housing"), a rubber plug, fitted on an end portion of the wire, forms a seal relative to the exterior.

An example of a construction including a pair of waterproof connectors respectively having female and male terminals will now be described with reference to FIG. 5.

As shown in FIG. 5, the male terminal 2 has a centerline 2A extending through the center of the cross-sectional area of a male tab 2D, formed at a front end thereof, to a wire holder portion 2E formed at a rear end thereof. It is preferred that a centerline of a covered wire 5, compressively clamped by the wire holder portion 2E of the male terminal 2, either be aligned with the centerline 2A of the terminal or extend in the vicinity of this terminal centerline 2A. However, since the diameter of the covered wire 5 is larger than the thickness of the male tab 2D, they are not aligned with each other, and therefore it is necessary to make an adjustment by the wire holder portion 2E. A slanting portion or stepped portion 2B is provided for the purpose of this adjustment. As a result of the provision of this slanting portion 2B, a surface 2C of a base plate of the wire holder portion 2E is projected to a level below the male tab 2D. With this arrangement, the centerline of the covered wire 5 is either accurately or generally aligned with the centerline 2A of the terminal. Therefore, the male terminal 2 can be quite easily inserted into a female housing 20.

Then, a rubber plug 4, having a passage hole, is fitted on the front end portion of the covered wire 5. Then, the male terminal 2, having the rubber plug 4 fitted thereon, is inserted into the female housing 20. As a result, the male tab 2D is projected from a partition wall provided at a front portion of the female housing 20. At this time, the rubber plug 4 is press-fitted in a cavity 21 provided at a rear portion of the female housing 20. The outer diameter of the rubber plug 4 is larger than the diameter of the cavity, and upon press-fitting, an outer peripheral portion of the rubber plug is compressed. This compressed outer peripheral portion, that is, a sealing portion seals the cavity 21 relative to the exterior.

A male housing 11, having a female terminal 12 fitted therein, is fitted in the female housing 20, having the male terminal 2 fitted therein in this sealed condition, from the front side of this female housing. At this time, the male terminal 2 is fitted in the female terminal 12 to make an electrical connection therebetween. Incidentally, the female terminal 12, as in the male terminal 2, is sealed within the male housing 11 by a rubber plug 13 fitted on a front end of a covered wire 15 connected to the female terminal 12.

As described above, the specified covered wire is used according to its intended place and purpose, and predetermined connection terminal and housing are selected and used. Namely, one or few kinds of connection terminals, as well as one or few kinds of housings, could be used relative to the specified covered wire.

Therefore, when trying to use any one of a plurality of kinds of covered wires relative to one kind of connection terminal, problems arise with the strength of the connection terminal relative to the covered wire, as well as a retaining structure within the housing.

As described above, in the housing 20 of the above construction, from the viewpoints of the terminal inserting operation and the sealing ability of the rubber plug, the centerline 4C of the rubber plug and the centerline 21B of the cavity should preferably be aligned either accurately or generally.

However, in the case where a plurality of covered wires 5 of different outer diameters are compatible with the common male terminal 2, a problem arises with the wire holder portion 2E. For example, assuming that the height of clamping (hereinafter referred to as "clamping height") of the covered wire with an average outer diameter is a reference height, the clamping height of the covered wire with a larger diameter is larger, and also the clamping height of the covered wire with a smaller diameter is smaller.

When a covered wire 5C of the reference diameter is clamped by the male terminal 2 as shown in FIG. 6, the rubber plug 4 through which the covered wire 5C passes has a rubber plug centerline 22, and the cavity 21 at the rear portion of the housing 20 has a cavity centerline 23. At this time, the rubber plug centerline 22 is aligned with the cavity centerline 23. In the drawings, a sealing portion on the upper side of the centerline of the covered wire 5C is designated by w5 while a sealing portion on the lower side is designated by w6.

As shown in FIG. 7, a sealing portion w is uniformly formed between the outer periphery 26A of the rubber plug in a non-compressed condition (non-fitted condition) and the outer periphery 26B of the rubber plug in a compressed condition (fitted condition) over the entire periphery. In this case, the outer periphery 26B of the rubber plug in the compressed condition (fitted condition) is equal to an inner periphery 21A (FIG. 6) of the cavity.

A problem arises when a covered wire 5B larger in diameter than the covered wire 5C of the reference diameter is clamped as shown in FIG. 8. In this case, the covered wire 5B of a larger diameter is connected and held, using the male terminal 2 and the housing 20 which have the same sizes and shapes, respectively, as described above. Therefore, since the position of the base plate surface 2C is not changed, the position of the male terminal 2 within the housing 20 is not changed.

On the other hand, since the covered wire 5B has a larger diameter, the clamp height is larger when this wire is placed on the base plate surface 2C, and the centerline of the covered wire 5B of a larger diameter is shifted upwardly, and also the centerline 24 of the rubber plug through which the wire passes is also shifted upwardly. Namely, the centerline 24 of the rubber plug is not aligned with the centerline 25 of the cavity.

In this condition, when the male terminal 2 is inserted into the housing 20 as shown in FIG. 9, the sealing portion w at the outer peripheral portion of the rubber plug 4 is large at an upper portion whereas the sealing portion is hardly provided at a lower portion. Namely, with respect to the sealing portion w between the outer periphery 26A of the rubber plug in the non-compressed condition and the outer periphery 26B of the rubber plug in the compressed condition (fitted condition), the upper sealing portion w5 is large whereas the lower sealing portion w6 is hardly provided, thus causing an uneven condition. In an extreme case, there is a fear that a gap 27 may be formed between the lower end of the rubber plug 4 and the inner periphery 21A of the cavity. In such a condition, it is difficult to ensure a good waterproof ability.

SUMMARY OF THE INVENTION

The present invention has been made in view of the above problems, and an object of the invention is to provide a waterproof connector which can hold any one of a plurality of kinds of covered wires of different outer diameters by the use of the connection terminal and the same housing, and can ensure a good waterproof function.

The above object of the invention can be achieved by a waterproof connector wherein a covered wire of an average diameter is connected to a rear end portion of a connection terminal, and the connection terminal, having the covered wire passed through a rubber plug having a passage hole formed through a central portion thereof, is inserted in a cylindrical cavity formed in a rear end portion of a connector housing, wherein a centerline of the cavity is offset from a centerline of the rubber plug, through which the covered wire is passed, toward or away from a surface of a base plate of the connection terminal so that a covered wire smaller or larger in diameter than the average-diameter covered wire can be suitably connected to the connection terminal.

Also, the above object of the invention can be achieved by a waterproof connector wherein a covered wire of a small diameter defining a covered wire of an average diameter is connected to a rear end portion of a male terminal, and the male terminal, having the covered wire passed through a rubber plug having a passage hole formed through a central portion thereof, is inserted in a cylindrical cavity formed in a rear end portion of a connector housing, wherein a centerline of the cavity is offset from a centerline of the rubber plug, through which the small-diameter covered wire is passed, in a direction away from a surface of a base plate of the male terminal so that a covered wire larger in diameter than the small-diameter covered wire can be suitably connected to the male terminal.

Further, the above object of the invention can be achieved by a waterproof connector wherein a covered wire of a large diameter defining a covered wire of an average diameter is connected to a rear end portion of a male terminal, and the male terminal, having the covered wire passed through a rubber plug having a passage hole formed through a central portion thereof, is inserted in a cylindrical cavity formed in a rear end portion of a connector housing, wherein a centerline of the cavity is offset from a centerline of the rubber plug, through which the large-diameter covered wire is passed, in a direction toward from a surface of a base plate of the male terminal so that a covered wire smaller in diameter than the large-diameter covered wire can be suitably connected to the male terminal.

In the waterproof connector of the above construction according to the present invention, the centerline of the cavity is offset from the centerline of the rubber plug, through which the covered wire is passed, toward or away from the surface of the base plate of the connection terminal so that a covered wire smaller or larger in diameter than the average-diameter covered wire can be suitably connected to the connection terminal.

Therefore, when the covered wire of a smaller or a larger diameter is clamped on the base plate surface of the connection terminal, the centerline of the rubber plug is offset toward or away from the base plate surface. However, the centerline of the cavity is beforehand offset toward or away from the base plate surface, and therefore when the male terminal, fixedly connected to the covered wire of a smaller or a larger diameter, is inserted into the housing, the centerline of the rubber plug is aligned with or generally aligned with the centerline of the cavity.

As a result, a sealing portion is uniformly formed between the inner periphery of the cavity and the rubber plug over the entire periphery even if the covered wire of a smaller or a larger diameter is held by the terminal.

Also, in the waterproof connector of the above construction according to the present invention, the centerline of the cavity is offset from the centerline of the rubber plug, through which the small-diameter covered wire is passed, in a direction away from the surface of the base plate of the male terminal so that a covered wire larger in diameter than the small-diameter covered wire can be suitably connected to the male terminal.

Therefore, when the covered wire of a larger diameter is clamped on the base plate surface of the connection terminal, the centerline of the rubber plug is offset away from the base plate surface. However, the centerline of the cavity is beforehand offset away from the base plate surface, and therefore when the male terminal, fixedly connected to the larger-diameter covered wire, is inserted into the housing, the centerline of the rubber plug is aligned with or generally aligned with the centerline of the cavity.

As a result, a sealing portion is uniformly formed between the inner periphery of the cavity and the rubber plug over the entire periphery even if the larger-diameter covered wire is held by the terminal.

Further, in the waterproof connector of the above construction according to the present invention, the centerline of the cavity is offset from the centerline of the rubber plug, through which the large-diameter covered wire is passed, in a direction toward from the surface of the base plate of the male terminal so that a covered wire smaller in diameter than the large-diameter covered wire can be suitably connected to the male terminal.

Therefore, when the covered wire of a smaller diameter is clamped on the base plate surface of the connection terminal, the centerline of the rubber plug is offset toward the base plate surface. However, the centerline of the cavity is beforehand offset toward the base plate surface, and therefore when the male terminal, fixedly connected to the smaller-diameter covered wire, is inserted into the housing, the centerline of the rubber plug is aligned with or generally aligned with the centerline of the cavity.

As a result, a sealing portion is uniformly formed between the inner periphery of the cavity and the rubber plug over the entire periphery even if the smaller-diameter covered wire is held by the terminal.

Therefore, a plurality of kinds of covered wires of different outer diameters can be connected and held by the use of the male terminal having the predetermined size and shape in such a manner that the waterproof function is maintained by the rubber plug.

DETAILED DESCRIPTION OF THE PREFERRED EMBODIMENTS

Figure 1:
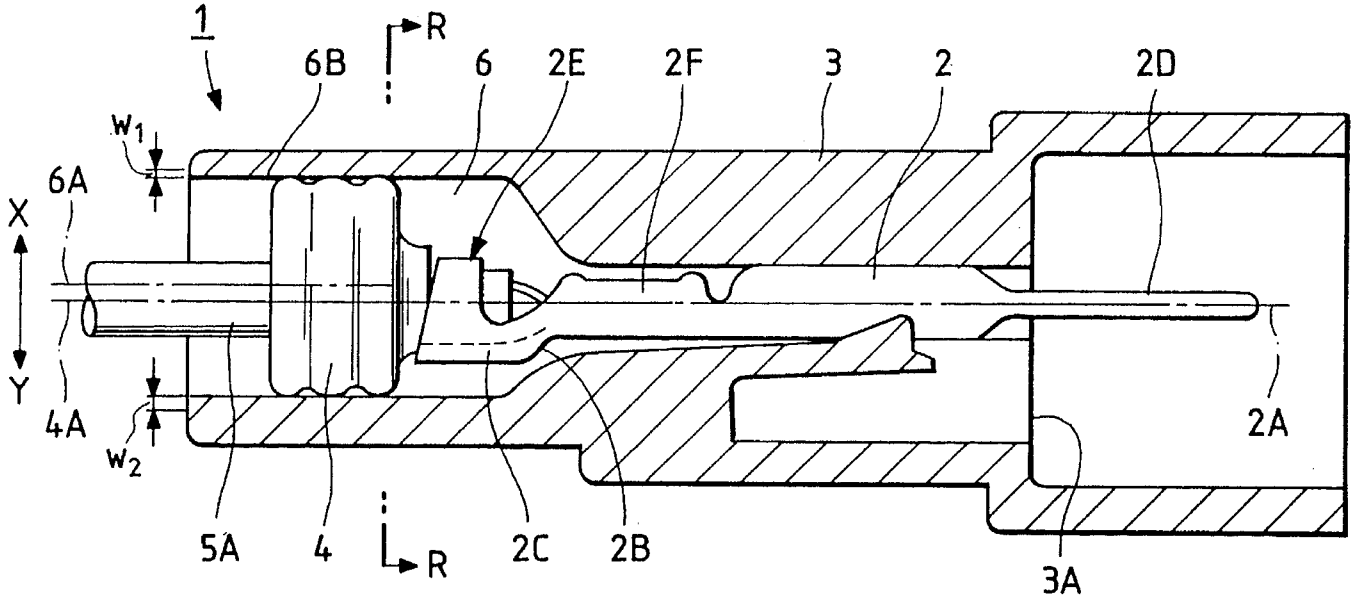
FIG. 1 is a cross-sectional view of one preferred embodiment of a waterproof connector of the present invention.
Figure 2:
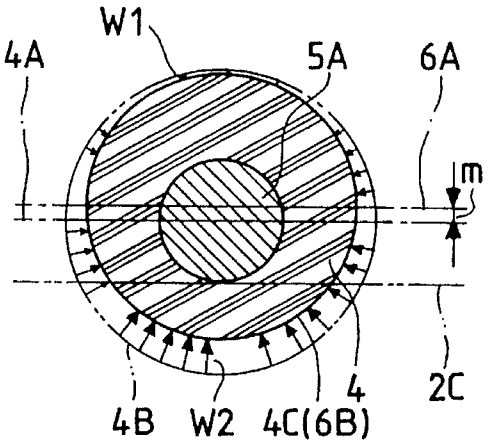
FIG. 2 is a cross-sectional view taken along the line R—R of FIG. 1.

One preferred embodiment of a waterproof connector of the present invention will now be described in detail with reference to FIGS. 1 and 2. FIG. 1 is a cross-sectional view of one preferred embodiment of the waterproof connector of the invention, and FIG. 2 is a cross-sectional view taken along the line R—R of FIG. 1.

As shown in FIG. 1, the waterproof connector 1 of this embodiment comprises a housing 3 having a cavity 6 formed therein, and a male terminal 2 inserted in the housing 3, the male terminal 2 being connected to a covered wire 5A. The male terminal 2 has a male tab 2D at its front end, a conductor connecting portion 2F at its intermediate portion, and a wire holder portion 2E at its rear end.

This terminal has a centerline 2A passing through the center of the male tab 2D along the wire holder portion 2E.

The wire holder portion 2E has a base plate surface 2C on which a front end portion of the covered wire 5A is placed. The base plate surface 2C is disposed rearwardly of the male tab 2D via a slanting portion 2B, and is offset from the terminal centerline 2A. A front end portion of a covering of the covered wire 5A of a small diameter is placed on this base plate surface 2C, and is compressively clamped. A conductor exposed from the front end of the covered wire 5A is compressively clamped by the conductor connecting portion 2F, thereby making an electrical connection therebetween.

Then, the covered wire 5A is passed through a rubber plug 4 having a passage hole formed through a central portion thereof. Alternatively, the covered wire 5A, beforehand passed through the rubber plug 4, may be connected to the male terminal 2. Then, the male terminal 2, connected to the covered wire 5A with the rubber plug 4, is inserted into the housing 3.

With this arrangement, the male tab 2D at the front end of the male terminal 2 projects from a partition wall 3A of the housing 3. At this time, the rubber plug 4 is fitted into the cavity 6 in the rear end portion of the housing 3. The outer diameter of the rubber plug 4 is larger than the inner diameter of the cavity 6, and when the rubber plug 4 is fitted in the cavity, an outer peripheral portion of this rubber plug is compressed. The cavity 6 is sealed from the exterior by the thus compressed outer peripheral portion of the rubber plug 4.

In this embodiment, when the rubber plug 4 is fitted in the housing 3, a centerline 4A of the rubber plug 4 is offset from a centerline 6A of the cavity toward the base plate surface 2C. Namely, the cavity 6 is formed in the housing 3 in such a manner that the centerline 6A of the cavity is offset from the centerline 4A of the rubberplug in a direction X away from the base plate surface 2C.

As shown in FIG. 2, the covered wire 5A of a small diameter is connected to the male terminal 2, and the rubber plug fitted on the covered wire 5A has the centerline 4A. The cavity 6 formed in the rear end portion of the housing 3 has the centerline 6A. The centerline 6A of the cavity is offset an amount m from the centerline 4A of the rubber plug in the direction X away from the base plate surface 2C, as described above for FIG. 1.

As a result, a sealing portion w is formed between the outer periphery 4B of the rubber plug in a non-compressed condition (non-fitted condition) and the outer periphery 4C of the rubber plug in a compressed condition (fitted condition) over the entire periphery; however, an upper sealing portion w1 is slightly smaller than a lower sealing portion w2. The outer periphery 4C of the rubber plug in the compressed condition (fitted condition) is equal to a inner periphery 6B of the cavity.

In the above construction, reference is now made to the case where a covered wire 5B of a large diameter is connected to the male terminal 2. Since the position of retaining of the male terminal 2 within the housing 3 is not changed, the position of the base plate surface 2C is not changed.

On the other hand, a clamping height of the large-diameter covered wire 5B clamped on the base plate surface 2C is larger, and the centerline of the large-diameter covered wire 5B is shifted upwardly, and also the centerline 4A of the rubber plug is shifted upwardly. In this condition, when the male terminal 2 is inserted into the housing 3, the centerline 4A of the rubber plug is shifted in such a direction as to be aligned with the centerline 6A of the cavity since the centerline 6A of the cavity is originally offset an amount m upwardly.

Therefore, the sealing portion w at the outer periphery 4C of the rubber plug in the fitted condition becomes uniform over the entire periphery. Namely, the upper sealing portion w1 becomes equal or generally equal to the lower sealing portion w2. Therefore, even when the large-diameter covered wire 5B is connected, a good waterproof ability can be achieved as is the case with the small-diameter covered wire 5A.

Figure 3:
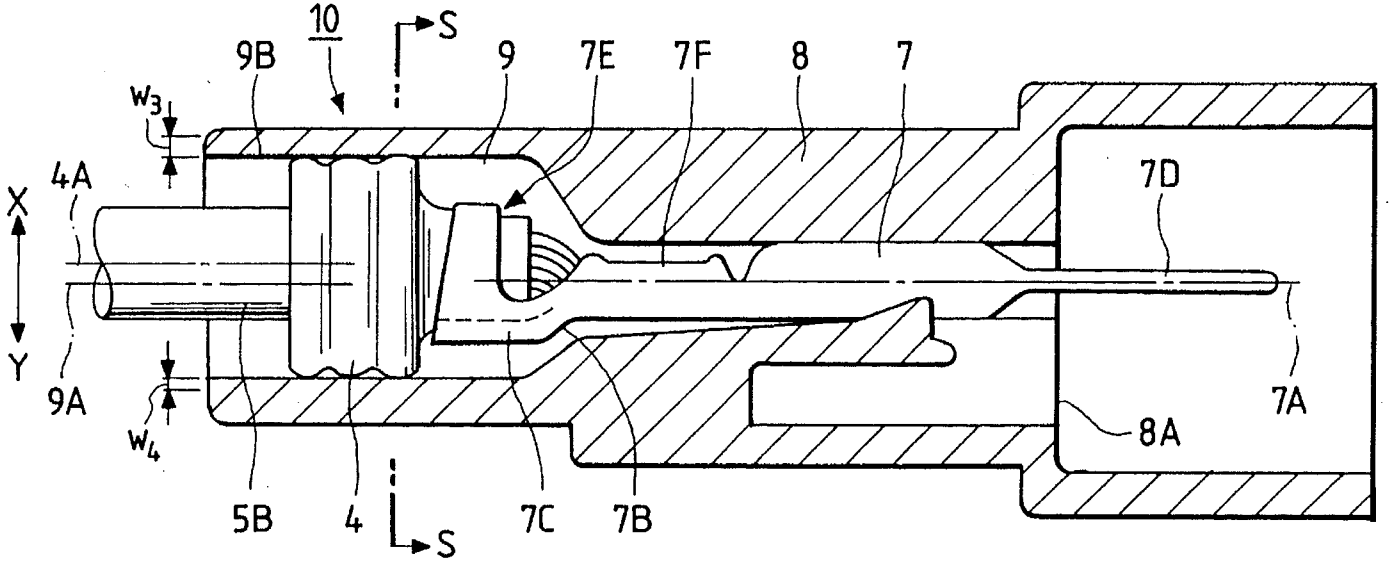
FIG. 3 is a cross-sectional view of a second embodiment of a waterproof connector of the invention.
Figure 4:
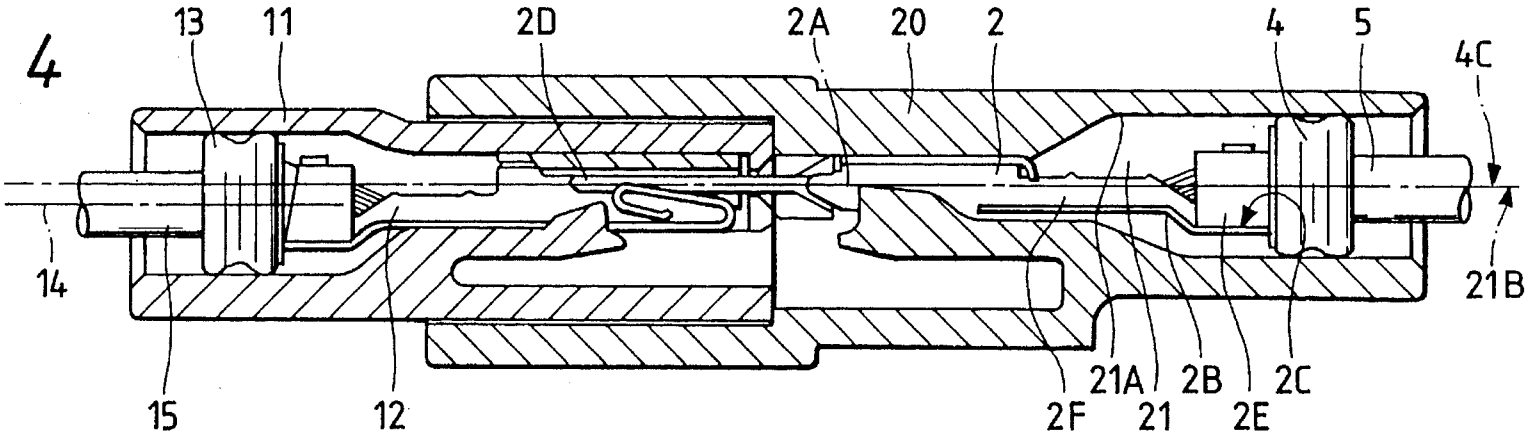
FIG. 4 is a cross-sectional view taken along the line S—S of FIG. 3.
Figure 5:
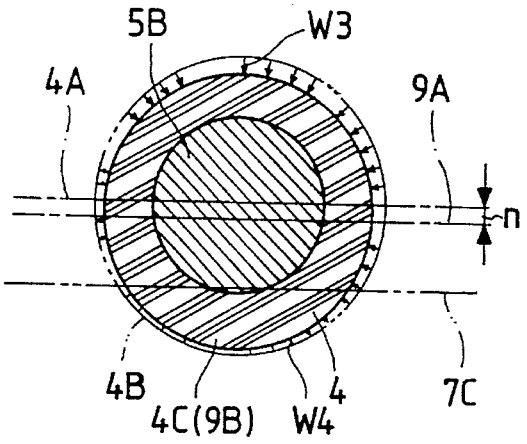
FIG. 5 is a cross-sectional view showing conventional waterproof connectors fitted together.
Figure 6:
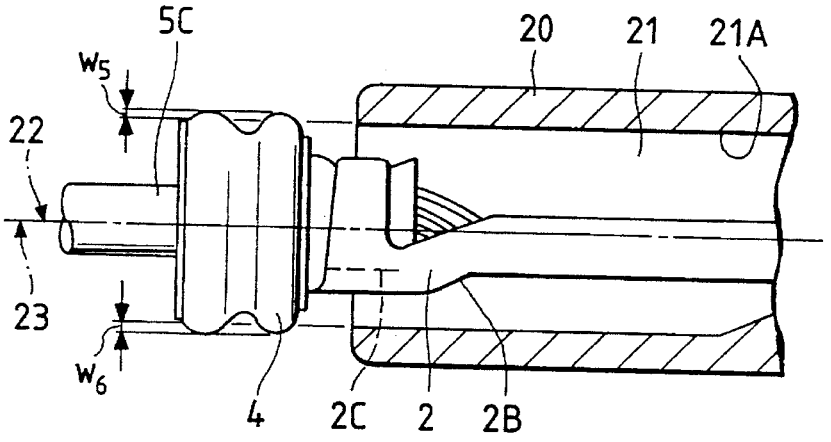
FIG. 6 is a cross-sectional view explanatory of the function of the conventional waterproof connector.
Figure 7:
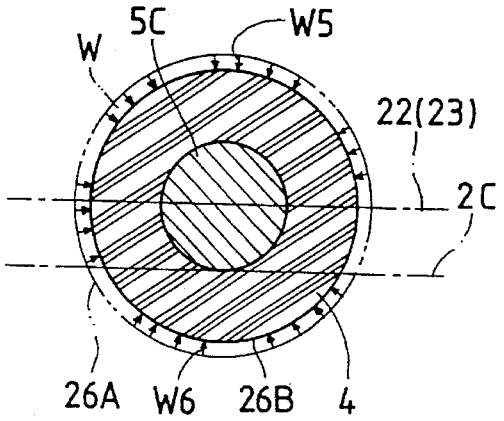
FIG. 7 is a cross-sectional view of the connector of FIG. 6.
Figure 8:
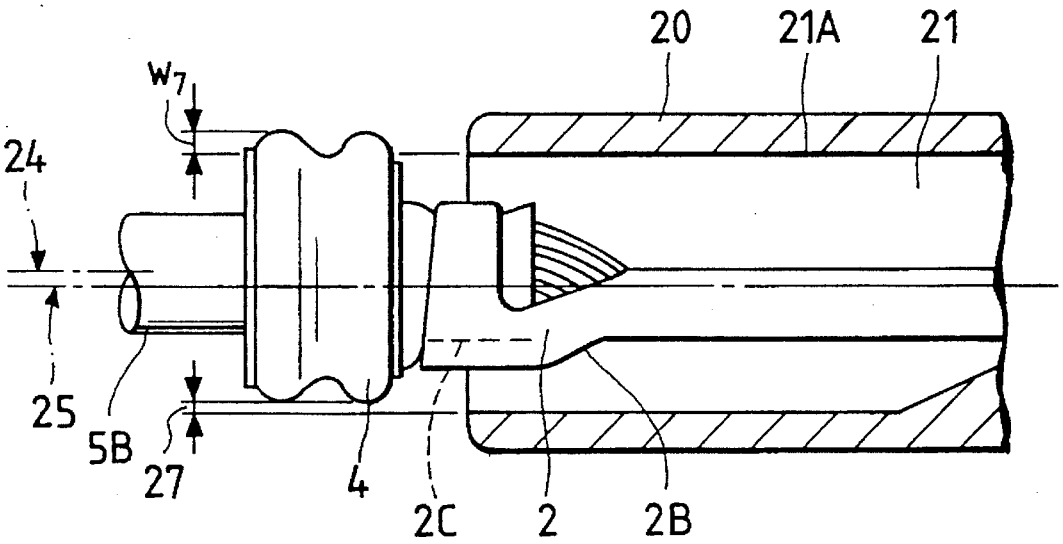
FIG. 8 is a cross-sectional view of the waterproof connector of FIG. 6, showing a condition in which a wire of a larger diameter is connected.
Figure 9:
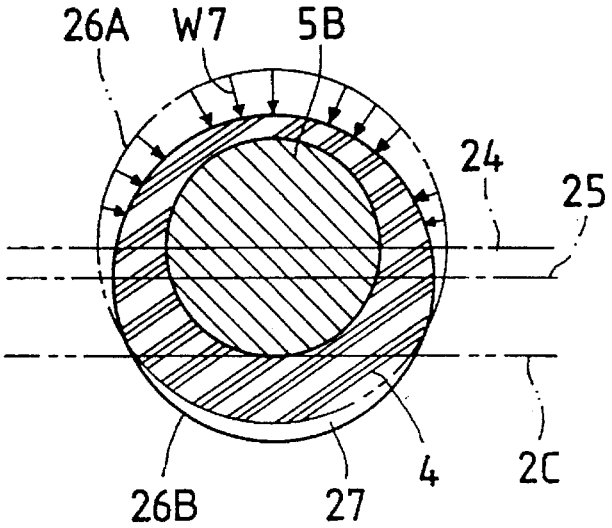
FIG. 9 is a cross-sectional view of the connector of FIG. 8.

Next, another embodiment of a waterproof connector of the present invention will now be described in detail with reference to FIGS. 3 and 4. FIG. 3 is a cross-sectional view of a second embodiment of a waterproof connector of the invention, and FIG. 4 is a cross-sectional view taken along the line S—S of FIG. 3. Explanation of those portions identical to those of the above first embodiment will be omitted.

As shown in FIG. 3, the waterproof connector 10 of this embodiment comprises a housing 8 having a cavity 9 formed therein, and a male terminal 7 inserted in the housing 8, the male terminal 7 being connected to a covered wire 5B.

A front end portion of a covering of the covered wire 5B of a large diameter is placed on a base plate surface 7C of a wire holder portion 7E, and is compressively clamped. Then, the male terminal 7, connected to the large-diameter covered wire 5B with a rubber plug 4, is inserted into the housing 8. At this time, the rubber plug 4 is fitted into the cavity 9 formed at the rear end portion of the housing 8.

In this embodiment, the cavity 9 is formed in the housing 8 in such a manner that a centerline 9A of the cavity is offset from a centerline 4A of the rubber plug in a direction Y toward the base plate surface 7C when the rubber plug 4 is fitted in the housing 8.

As shown in FIG. 4, the centerline 9A of the cavity is offset an amount n from the centerline 4A of the rubber plug in the direction Y toward the base plate surface 7C.

As a result, a sealing portion w is formed between the outer periphery 4B of the rubber plug in a non-compressed condition (non-fitted condition) and the outer periphery 4C of the rubber plug in a compressed condition (fitted condition); however, an upper sealing portion w3 is slightly larger than a lower sealing portion w4. The outer periphery 4C of the rubber plug in the compressed condition (fitted condition) is equal to an inner periphery 9B of the cavity.

In the above construction, reference is now made to the case where a covered wire 5A of a small diameter is connected to the male terminal 7. Since the position of retaining of the male terminal 7 within the housing 8 is not changed, the position of the base plate surface 7C is not changed.

On the other hand, a clamping height of the small-diameter covered wire 5A clamped on the base plate surface 7C is smaller, and the centerline of the small-diameter covered wire A is shifted downwardly, and also the centerline 4A of the rubber plug is shifted downwardly. In this condition, when the male terminal 7 is inserted into the housing 8, the centerline 4A of the rubber plug is shifted in such a direction as to be aligned with the centerline 9A of the cavity since the centerline 9A of the cavity is originally offset an amount n downwardly.

Therefore, the sealing portion w at the outer periphery 4C of the rubber plug in the fitted condition becomes uniform over the entire periphery. Namely, the upper sealing portion w3 becomes equal or generally equal to the lower sealing portion w4. Therefore, even when the small-diameter covered wire 5A is connected, a good waterproof ability can be achieved as is the case with the large-diameter covered wire 5B.

With the construction of the above embodiments, a plurality of kinds of covered wires of different wires can be connected by the use of the same male terminal and the same housing, and also a good waterproof ability can be achieved by the use of the rubber plugs corresponding to the respective covered wires.

Advantageous Effects of the Invention

As described above, in the waterproof connector of the present invention, the centerline of the cavity is offset from the centerline of the rubber plug, through which the covered wire is passed, toward or away from the surface of the base plate of the connection terminal so that a covered wire smaller or larger in diameter than the average-diameter covered wire can be suitably connected to the connection terminal.

Also, in the waterproof connector of the present invention, the centerline of the cavity is offset from the centerline of the rubber plug, through which the small-diameter covered wire is passed, in a direction away from the surface of the base plate of the male terminal so that a covered wire larger in diameter than the small-diameter covered wire can be suitably connected to the male terminal.

Further, in the waterproof connector of the present invention, the centerline of the cavity is offset from the centerline of the rubber plug, through which the large-diameter covered wire is passed, in a direction toward from the surface of the base plate of the male terminal so that a covered wire smaller in diameter than the large-diameter covered wire can be suitably connected to the male terminal.

Therefore, even if the covered wire larger or smaller in diameter than the average-diameter covered wire is connected, the sealing portion is formed uniformly between the inner periphery of the cavity and the rubber plug over the entire periphery. As a result, a plurality of kinds of covered wires of different outer diameters can be connected by the use of the male terminal having the predetermined size and shape, and besides a good waterproof function can be ensured.

What is claimed is:

1. A waterproof connector comprising:

a connector housing;

a terminal connected to a wire at a rear end portion of said connection terminal; and a rubber plug having a passage hole formed through a central portion thereof, inserted in a cylindrical cavity formed in a rear end portion of said connector housing, said wire being passed through said passage hole, wherein a centerline of said cavity is offset from a centerline of said rubber plug, through which said wire is passed, with respect to a surface of a base plate of said terminal.

2. A waterproof connector as claimed in claim 1, wherein, said center line of said cavity is offset from said centerline of said rubber plug away from the surface of a base plate of said connection terminal.

3. wherein, said center line of said cavity is offset from said centerline of said rubber plug toward the surface of a base plate of said connection terminal.

* * * * *